US008971729B2

(12) United States Patent
Yoshimura

(10) Patent No.: US 8,971,729 B2
(45) Date of Patent: Mar. 3, 2015

(54) IMAGE FORMING APPARATUS

(75) Inventor: Yuri Yoshimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 612 days.

(21) Appl. No.: 13/072,900

(22) Filed: Mar. 28, 2011

(65) Prior Publication Data

US 2011/0255882 A1 Oct. 20, 2011

(30) Foreign Application Priority Data

Apr. 15, 2010 (JP) ..... 2010-093920

(51) Int. Cl.
*G03G 15/00* (2006.01)
*B41J 29/13* (2006.01)
*B41J 13/00* (2006.01)

(52) U.S. Cl.
CPC ..... *G03G 15/6508* (2013.01); *B41J 13/0081* (2013.01); *B65H 2407/32* (2013.01); *B65H 2405/115* (2013.01); *G03G 2215/00776* (2013.01); *G03G 2215/00784* (2013.01)
USPC ..... 399/13; 399/393; 400/693

(58) Field of Classification Search
CPC ..... B65H 2404/5331; B65H 2405/115; B65H 2407/30; B65H 2407/32; B65H 2407/33; B65H 2407/311; G03G 2215/00784; G03G 2215/00717; G03G 2215/00776
USPC ..... 399/388, 380, 393
See application file for complete search history.

(56) References Cited

U.S. PATENT DOCUMENTS

| | | | | |
|---|---|---|---|---|
| 7,098,430 | B2 | 8/2006 | Kondo et al. | |
| 7,122,769 | B2 | 10/2006 | Nami et al. | |
| 7,132,631 | B2 | 11/2006 | Nami et al. | |
| 7,918,447 | B2 * | 4/2011 | One | 271/145 |
| 2006/0103866 | A1 * | 5/2006 | Saka et al. | 358/1.13 |

FOREIGN PATENT DOCUMENTS

| | | | |
|---|---|---|---|
| JP | 3-8637 | A | 1/1991 |
| JP | 2004-161456 | A | 6/2004 |
| JP | 2004189388 | A * | 7/2004 |

* cited by examiner

*Primary Examiner* — Matthew G Marini
*Assistant Examiner* — Justin Olamit
(74) *Attorney, Agent, or Firm* — Fitzpatrick, Cella, Harper & Scinto

(57) ABSTRACT

An image forming apparatus has a sheet feeding portion which feeds a topmost sheet of sheets stacked on a sheet stacking portion and an image forming portion which forms an image to the sheet fed by the sheet feeding portion. The image forming apparatus also has a moisture-proof member set to a covering position so as to contact with and cover a topmost sheet of sheets stacked on the sheet stacking portion, a moisture-proof member detection portion which determines whether the moisture-proof member is available at the covering position, and a notification portion which notifies the presence or absence of the moisture-proof member at the covering position based on a detection result from the moisture-proof member detection portion.

8 Claims, 10 Drawing Sheets

IMAGE FORMING APPARATUS

BACKGROUND OF THE INVENTION

1. Field of the Invention

The present invention relates to an image forming apparatus having a sheet feeding portion.

2. Description of the Related Art

Recently, there is an increasing demand for an image forming apparatus such as a copying machine or printer to copy or print highly smooth sheets such as art paper and coated paper used for flyers and posters. Unlike high-quality paper or plain paper, however, highly smooth sheets stick to each other due to moisture absorption. When the image forming apparatus is used in a humid environment, a sheet bundle in the sheet cassette absorbs moisture from the atmosphere and sticks. Reliably separating sheets one by one is difficult for the friction separation technique such as a separating pad technique or a retard separation technique.

Some apparatus uses a sheet-like moisture-proof member on the top surface of a sheet bundle stored in the sheet cassette in order to decrease moisture absorption into sheets and prevent sheets from sticking to each other. For example, the apparatus discussed in Japanese Patent Laid-Open No. 3-008637 includes a moisture-proof apparatus. The moisture-proof apparatus uses a moisture-proof sheet whose width almost equals the sheet width. The moisture-proof sheet abuts the internal surface of a width regulation plate and is regulated in terms of the lateral position. The moisture-proof sheet is placed so as to be in close contact with the top surface of sheets stored in the sheet cassette or stacked on a tray.

The sheet feeding apparatus proposed in Japanese Patent Laid-Open No. 2004-161456 separates sheets that absorb moisture and stick to each other. The sheets can be separated one by one for feeding. The sheet feeding apparatus provides a dehumidification portion on the top of a sheet bundle in the sheet cassette. The dehumidification portion includes two OHP sheets as synthetic resin plates that sandwich a sheet-like heater as a heat generator made of an SUS plate. The heater heats and dehumidifies moistened sheets so that the sheets can be separated.

To maximize the moisture-proof effect, the sheet-like moisture-proof member or the sheet-like moisture absorption portion including the heater must cover as wide a sheet surface area as possible while avoiding a sheet position regulating plate or a feeding roller around the stored sheet bundle. Differently sized moisture-proof members need to be used depending on sheet sizes. However, a user may inadvertently place a sheet bundle on the moisture-proof member or forget to set the moisture-proof member while replacing the moisture-proof member or supplying sheets to the sheet cassette. As a result, the moisture-proof member unsuccessfully provides the moisture-proof effect. Unnecessary sheets are fed.

The present invention provides an image forming apparatus capable of reliably stacking a moisture-proof member when an absorbent sheet is used for image formation.

SUMMARY OF THE INVENTION

According to one aspect of the present invention, there is provided an image forming apparatus having a sheet feeding portion which feeds a topmost sheet of sheets stacked on a sheet stacking portion and an image forming portion which forms an image to the sheet fed by the sheet feeding portion, the image forming apparatus including a moisture-proof member set to a covering position so as to contact with and cover a topmost sheet of sheets stacked on the sheet stacking portion, a moisture-proof member detection portion which determines whether the moisture-proof member is available at the covering position, and a notification portion which notifies the presence or absence of the moisture-proof member at the covering position based on a detection result from the moisture-proof member detection portion.

According to the invention, the notification portion notifies the absence of the moisture-proof member at the covering position. The moisture-proof member can be reliably mounted when an absorbent type of sheets such as art paper or coated paper needs to be used for image formation.

Further features of the present invention will become apparent from the following description of exemplary embodiments with reference to the attached drawings.

DESCRIPTION OF THE EMBODIMENTS

Embodiments of the present invention will be described in detail with reference to the drawings. Sizes, materials, shapes and relative positions of constituent parts described in the embodiments are appropriately changed according to configurations and various conditions of the apparatus to which the invention is applied. Therefore, the scope of the invention is not limited to those unless such sizes, materials, shapes or relative positions are specifically described.

First Embodiment

Figure 1:
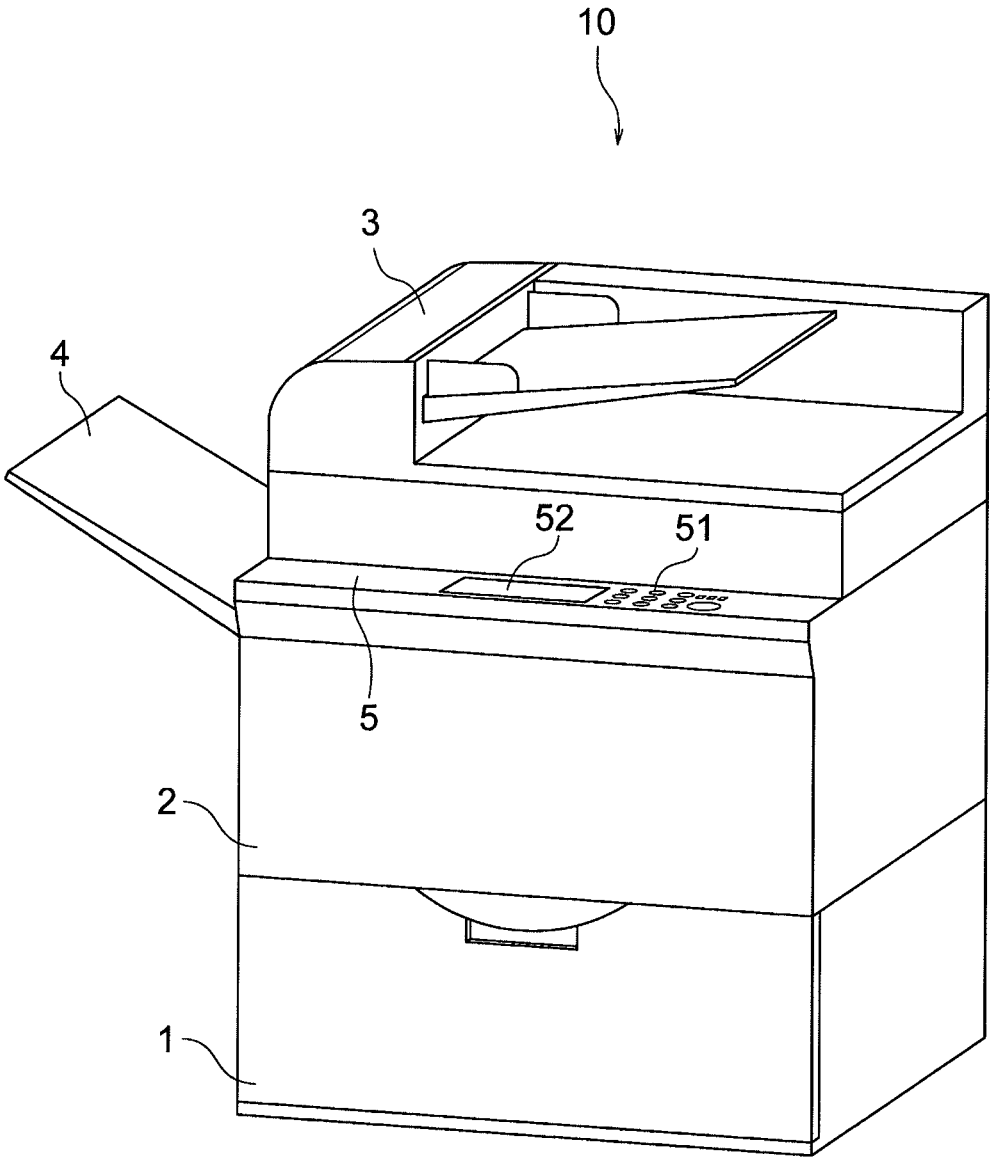
FIG. 1 is a schematic perspective view illustrating an image forming apparatus having a sheet feeding apparatus according to the present invention.

An outline configuration of an image forming apparatus will be described with reference to FIG. 1. As illustrated in FIG. 1, an image forming apparatus 10 includes a sheet feeding apparatus 1, an image forming portion 2, and an image reading portion 3. The sheet feeding apparatus 1 supports a sheet and feeds the sheet to the image forming portion 2. The image forming portion 2 forms an image on a fed sheet. The image reading portion 3 is connected to the image forming portion 2 and reads information on a document. The image forming apparatus 10 further includes a stacker 4 and a user communication portion 5. The stacker 4 stacks sheets ejected from the image forming portion 2. An image may be formed on each sheet. The user communication portion 5 exchanges various types of information with a user. The user communication portion 5 includes an input portion 51 and a display portion 52.

Figure 2:
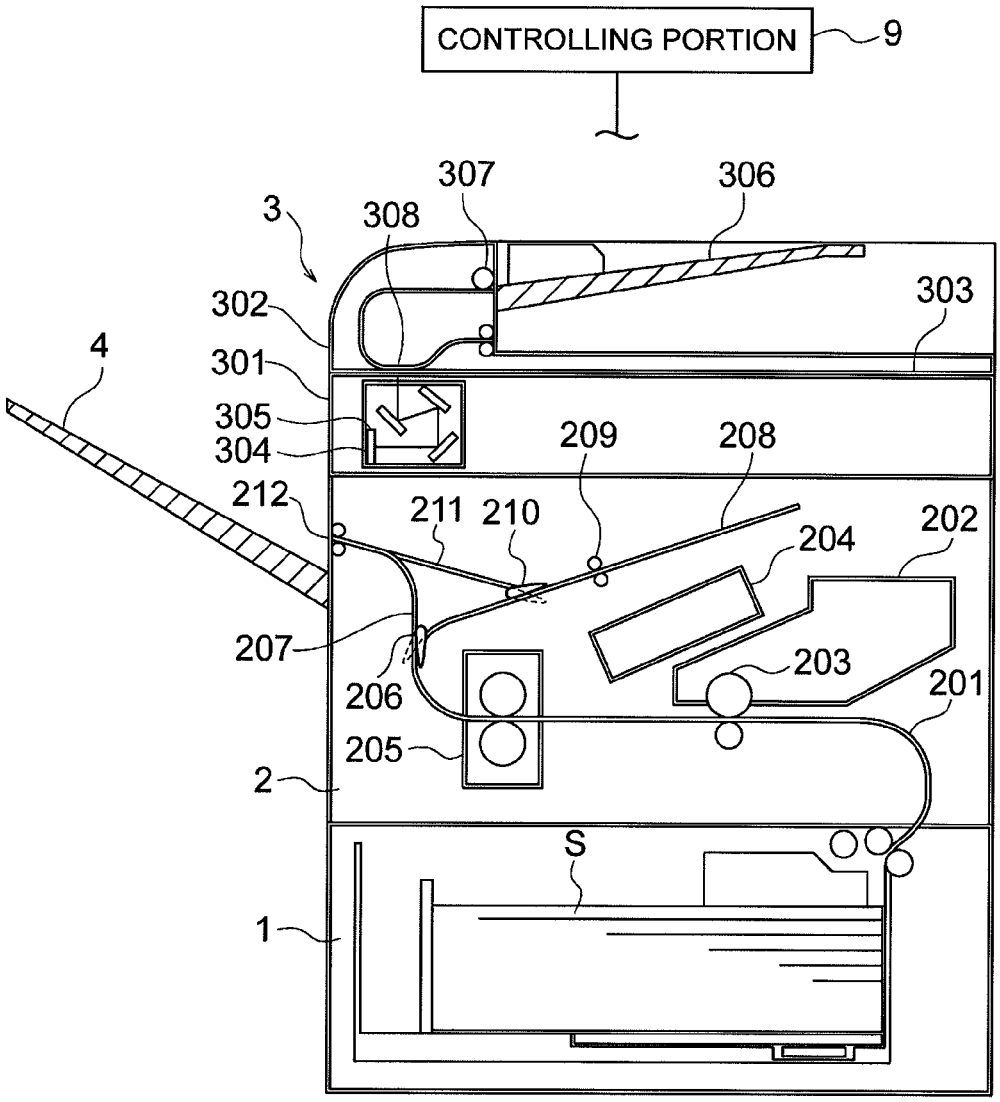
FIG. 2 is a schematic sectional view illustrating an image forming apparatus having a sheet feeding apparatus according to the present invention.

As illustrated in FIG. 2, the image forming portion 2 conveys a sheet S supplied from the sheet feeding apparatus 1 to an image forming process unit 202 through a conveying guide 201. The image forming process unit 202 uses an electrophotographic system to form an image (toner image). Specifically, the image forming portion 2 charges a photosensitive drum 203 as an image bearing member included in the image forming process unit 202. A laser scanner 204 irradiates light to form an image. Toner is used to develop the image. The toner image is transferred to the sheet. After the toner image is transferred to the sheet from the photosensitive drum 203, the sheet is conveyed to a fixing device 205. The fixing device 205 applies heat and pressure to the sheet to fix the image.

A conveying path switching member 206 conveys the sheet containing the fixed image to a face-up conveying path 207 or a switch-back conveying path 208 that changes the top and the bottom of a sheet. After the sheet is conveyed to the switch-back conveying path 208, a switch-back conveying roller 209 advances the sheet S until the rear end thereof passes through a reversal switching member 210.

The switch-back conveying roller 209 then changes the top and the bottom of the sheet S. The rear end of the sheet S becomes the top end. The sheet S is further conveyed in this state. The reversal switching member 210 operates to convey the reversed sheet S to a face-down conveying path 211. The face-up conveying path 207 and the face-down conveying path 211 join together before a discharge roller 212. The discharge roller 212 discharges a sheet guided to the face-up conveying path 207 and a sheet guided to the face-down conveying path 211 from the switch-back conveying path 208 both onto the stacker 4 from the image forming portion 2.

The image reading portion 3 includes a scanner 301 and an automatic document feeder (ADF) 302. The ADF 302 can open and close at a hinge (not illustrated) toward the rear of the apparatus. A user opens and closes the ADF 302 when placing a document on a platen glass 303. The scanner 301 includes a movable protruding carriage 304 and reads information from a document.

In the scanner 301, the protruding carriage 304 horizontally scans and reads information from a document placed on the platen glass 303. A CCD 305 photoelectrically converts the read information. Multiple sheets of document can be placed on a document stack tray 306. The ADF 302 allows a document feeding roller 307 to separately feed sheets one by one from the document stack tray 306. Each sheet passes through a document reading position 308 of the protruding carriage 304 stationary in the scanner 301. At this time, the protruding carriage 304 reads information from the conveyed document.

The image forming apparatus 10 includes a controlling portion 9. The controlling portion 9 totally controls the sheet feeding apparatus 1, the image forming portion 2, and the image reading portion 3. The controlling portion 9 can be placed anywhere in the image forming apparatus 10.

As illustrated in FIG. 1, the user communication portion 5 includes the input portion 51 and the display portion 52. The input portion 51 enables various input operations by a user. The display portion 52 displays results of user input and messages for prompting a user to perform predetermined operations. The user can enter the number of sheets to be printed from the input portion 51. The user can also select one-sided printing or two-sided printing, and a sheet type (type of sheet) from predetermined options.

Sheet type options include plain paper, colored paper, art paper, coated paper, heavy paper, and label paper. Selecting a sheet type accordingly optimizes conditions such as the toner concentration, the temperature of the fixing device 205, and the sheet conveying velocity. Specific sheet types such as art paper and coated paper easily absorb moisture in the air and can cause a feeding failure. Such sheet types are hereafter generically referred to as an absorbent sheet type.

Figure 3:
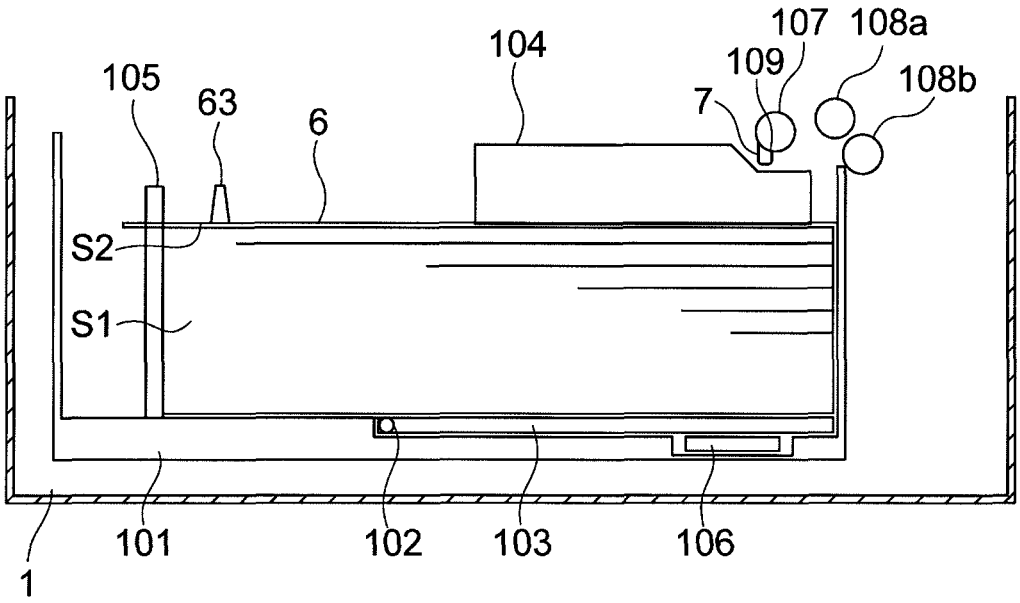
FIG. 3 is a schematic sectional view illustrating a sheet feeding apparatus according to a first embodiment of the present invention.

The configuration of the sheet feeding apparatus 1 will be described with reference to FIG. 3. FIG. 3 is a schematic sectional view illustrating the sheet feeding apparatus 1 included in the image forming apparatus 10 according to the first embodiment.

As illustrated in FIG. 3, the sheet feeding apparatus 1 is provided with a sheet cassette 101 that is detachably attachable to the feeding apparatus body. The sheet cassette 101 contains a support plate 103 for supporting the stored sheet bundle S1 and two side regulating plates 104 only one of which is illustrated in the drawing. The support plate 103 rotatively lifts and lowers around an axis 102 and configures a sheet stacking portion for stacking sheets. The sheet feeding apparatus 1 includes a pickup roller 107 and a pair of retard rollers 108*a* and 108*b* for separately feeding sheets one by one from a sheet S2 at the top of the stored sheet bundle S1. The pickup roller 107 and the retard rollers 108*a* and 108*b* configure a sheet feeding portion for feeding the topmost sheet S2 from the support plate 103.

The side regulating plates 104 abut the sides of the stored sheet bundle S1 and regulate a sheet position along the direction (from the front side to the rear side in FIG. 3) orthogonal to the feeding direction (to the right in FIG. 3) of the stored sheet bundle S1. The sheet cassette 101 further contains a rear end regulating plate 105 and a lifter mechanism 106. The rear end regulating plate 105 regulates the position of the stored sheet bundle S1 in the direction opposite the feeding direction. The lifter mechanism 106 uses a drive source (not illustrated) to rotatively lift and lower the support plate 103.

The lifter mechanism 106 rotatively moves the support plate 103 to lift the topmost sheet S2 on the stored sheet bundle S1 to a predetermined position. The pickup roller 107 then abuts the top surface of the sheet S2. The pickup roller 107 and the pair of retard rollers 108*a* and 108*b* separately feed the topmost sheet S2. Removing the sheet cassette 101 from the sheet feeding apparatus 1 disconnects the lifter mechanism 106 from the drive source. The support plate 103 and the lifter mechanism 106 lower under their own weights. The stored sheet bundle S1 accordingly lowers and is separated from the position capable of feeding.

The sheet S2 is lifted to a predetermined position and abuts the sheet sensor 109. The sheet sensor 109 then detects the sheet S2. An opening is formed in the support plate 103 so as to avoid contact with the sheet sensor 109 if the sheet S2 is unavailable at the predetermined position. When the support plate 103 lifts with no sheets stacked, the sheet sensor 109 does not turn on and notifies "no sheet". The sheet sensor 109 can use a non-contact sensor such as a photosensor or a mechanical contact type sensor.

A moisture-proof sheet 6 is placed (set) in contact with the top surface of the topmost sheet S2. When the support plate 103 rotatively lifts, the moisture-proof sheet 6 touches an electrode pair 7. The electrode pair 7 then detects the moisture-proof sheet 6. The moisture-proof sheet 6 configures a moisture-proof member that can be set to a covering position (illustrated in FIGS. 3 and 4) for covering in contact with the topmost sheet S2 on the stored sheet bundle S1 stacked on the support plate 103. The electrode pair 7 configures a moisture-proof member detection portion that detects whether the moisture-proof sheet 6 as the moisture-proof member is set to the covering position.

Figure 4:
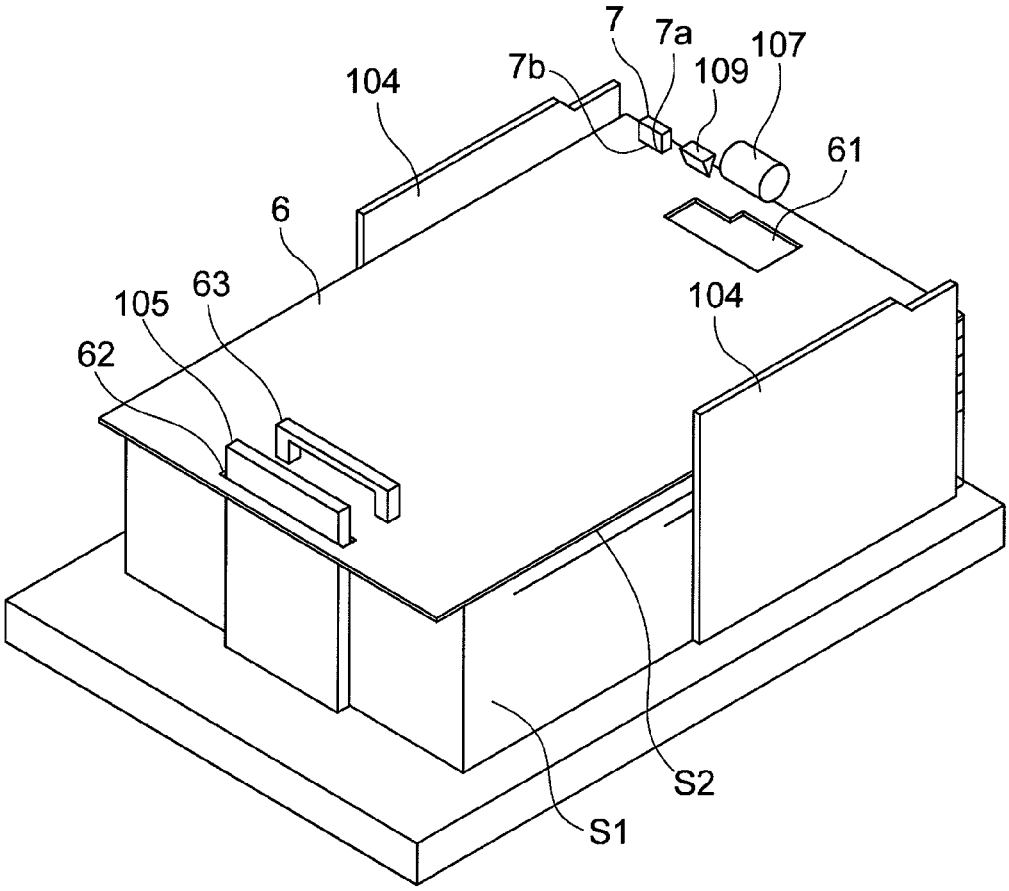
FIG. 4 is a schematic perspective view illustrating the inside of a sheet cassette according to the first embodiment of the present invention.

With reference to FIGS. 3 and 4, the following describes in detail the moisture-proof sheet 6 as the moisture-proof member and the electrode pair 7 as the moisture-proof member detection portion for detecting the moisture-proof sheet 6. FIG. 4 is a schematic perspective view illustrating the inside of the sheet cassette 101 according to the first embodiment of the invention.

The moisture-proof sheet 6 is made of a thin flat material such as PET (polyethylene terephthalate) film impervious to water or moisture. The moisture-proof sheet 6 is so flexible as to follow a wavy state of the stored sheet bundle S1 or deformation of the top surface of the stored sheet bundle S1 according to the lifted support plate 103. The flat material is coated with a metal film on its surface and provides conductivity in order to prevent static electricity due to friction with sheets. The moisture-proof sheet (moisture-proof member) 6 provides a conductive member. The electrode pair (moisture-proof member detection portion) 7 includes a pair of electrodes 7*a* and 7*b* that are contactable with the moisture-proof sheet 6. The presence or absence of the conduction between the electrodes indicates the presence or absence of the moisture-proof sheet 6.

The input portion 51 and the display portion 52 configure a notification portion that notifies the presence or absence of the moisture-proof sheet (moisture-proof member) 6 at the covering position based on a detection result from the electrode pair (moisture-proof member detection portion) 7. The notification portion includes the input portion 51 for entering sheet types of the topmost sheet S2 and the display portion 52 for prompting a user to a predetermined operation. The notification portion allows the display portion 52 to display information corresponding to a combination of the detection result from the electrode pair 7 and the sheet type entered from the input portion 51. There may be a case where the input portion 51 is supplied with the selection of the absorbent sheet type, the sheet type absorbent of moisture in the air, and the electrode pair 7 detects the absence of the moisture-proof sheet 6 at the covering position. In such a case, the notification portion allows the display portion 52 to display a prompt to mount the moisture-proof sheet 6. These processes performed by the notification portion are also available for the third and fourth embodiments to be described later.

The moisture-proof sheet 6 is placed on the surface of the stored sheet bundle S1, i.e., the surface of the topmost sheet S2, to prevent the stored sheet bundle S1 from absorbing the moisture from the sheet surface. Although the sheet edge absorbs moisture, a moistened area is much smaller than the entire sheet area. Just preventing the sheet surface from absorbing moisture sufficiently decreases the chances of absorption among sheets and a resulting feeding failure.

An aperture 61 is formed in the moisture-proof sheet 6 in order to avoid contact with the pickup roller 107, the sheet sensor 109, and parts related to sheet feeding. An aperture 62 is formed in the moisture-proof sheet 6 opposite the aperture 61. When the moisture-proof sheet 6 is placed on the surface of the stored sheet bundle S1, the rear end regulating plate 105 is inserted into the aperture 62 and engages with the moisture-proof sheet 6. The engagement can prevent the moisture-proof sheet 6 from being conveyed together with the topmost sheet S2 that may be fed by any possibility.

A protruding portion 63 is provided near the aperture 62 in the moisture-proof sheet 6. The protruding portion 63 is shaped into a handle so that a user or an operator can use the protruding portion 63 as a handle for the moisture-proof sheet 6. The protruding portion 63 prevents sheets from being placed flat on the moisture-proof sheet 6 (moisture-proof member). The protruding portion 63 can prevent the user from inadvertently placing sheets on the moisture-proof sheet 6 in the sheet cassette 101. The moisture-proof sheet (moisture-proof member) 6 is provided with the protruding portion 63 that protrudes upward when the moisture-proof sheet 6 is set to the covering position. The protruding portion 63 alerts the user to placement of a sheet on the moisture-proof sheet 6.

The electrode pair 7 has two electrodes 7*a* and 7*b* electrically connected to the controlling portion 9. When the moisture-proof sheet 6 is lifted to a predetermined position according to rotative movement of the support plate 103, the electrodes 7*a* and 7*b* abut the surface of the moisture-proof sheet 6. The electrodes 7*a* and 7*b* are then electrically connected because the moisture-proof sheet 6 is conductive. When the electrodes 7*a* and 7*b* do not abut the surface of the moisture-proof sheet 6, the electrodes 7*a* and 7*b* remain insulated from each other. The controlling portion 9 determines the presence or absence of the moisture-proof sheet 6 based on the presence or absence of conduction between the electrodes 7*a* and 7*b*. The embodiment uses the electrode pair 7 as mentioned above and need not use a special sensor for detecting the moisture-proof sheet 6. The configuration is simplified. In the following description, "detecting the presence or absence of the moisture-proof sheet" or a similar expression is equivalent to checking for conduction of the electrode pair 7.

When the sheet bundle S1 is stored in the sheet cassette 101, the controlling portion 9 outputs an instruction for predetermined display to the display portion 52 according to the sheet type selected by the user from the input portion 51 and the result of detecting the moisture-proof sheet 6.

Figure 5:
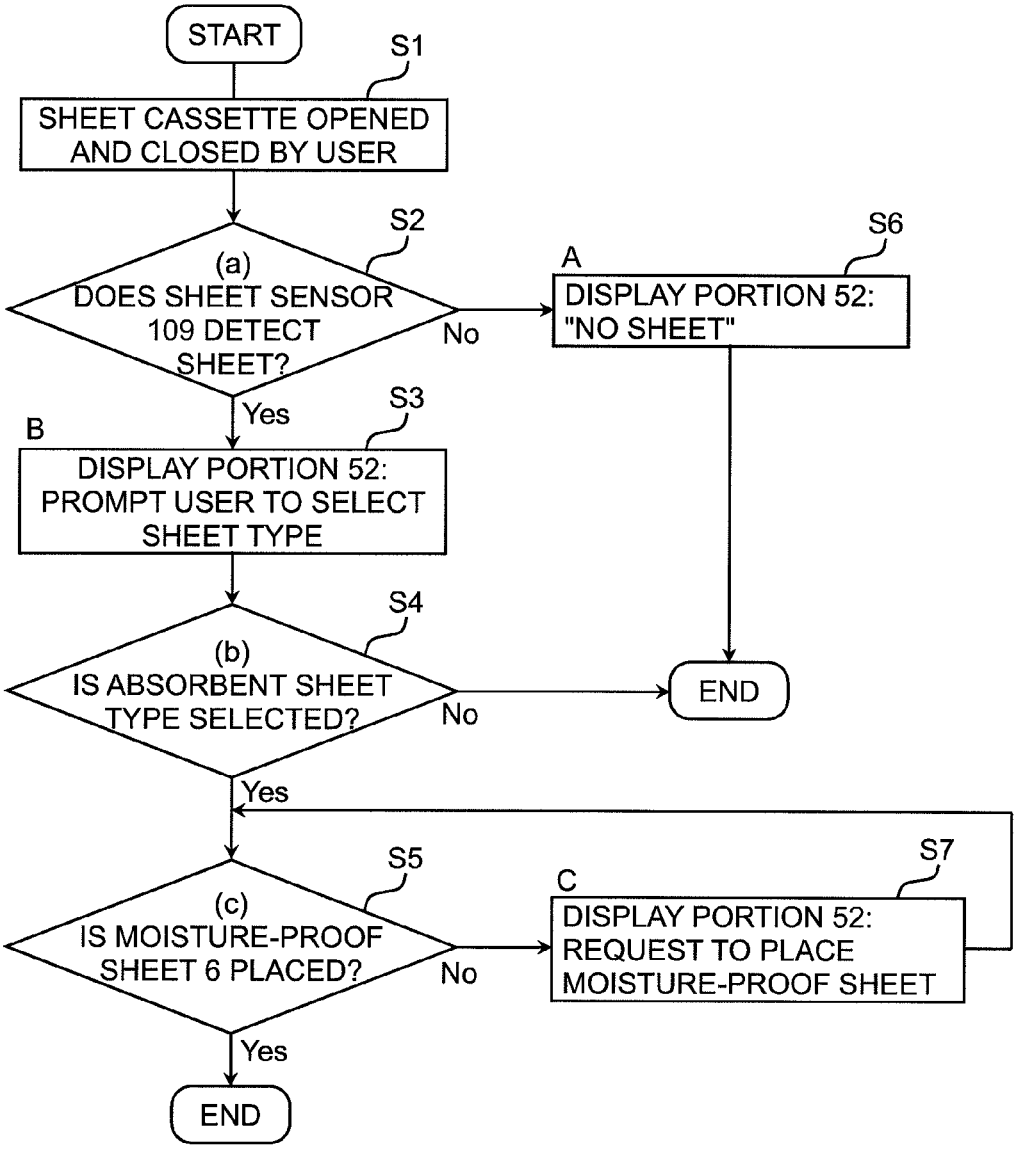
FIG. 5 is a flowchart concerning a moisture-proof sheet according to the first embodiment.

The processes will be described in detail with reference to a flowchart in FIG. 5. In the following description, the expression of "displaying" is equivalent to displaying a predetermined message on the display portion 52.

At step S1, the controlling portion 9 detects that the user opens the sheet cassette 101 to remove it from the sheet feeding apparatus 1 and then closes the sheet cassette 101 to mount it. The controlling portion 9 then rotatively lifts the support plate 103. At step S2, the controlling portion 9 determines whether the sheet sensor 109 detects a sheet (a). When no sheet is detected at step S2, the controlling portion 9 proceeds to step S6, allows the display portion 52 to display "no sheet" (A), and terminates the process. When a sheet is detected at step S2, the controlling portion 9 proceeds to step S3 and displays a request for selecting a sheet type for the mounted sheet bundle (B).

At step S5, the controlling portion 9 determines whether the moisture-proof sheet 6 is placed at the covering position (c). When it is determined that the moisture-proof sheet 6 is not mounted, the controlling portion 9 allows the display portion 52 to display a message prompting the user to mount the moisture-proof sheet 6 (C).

As mentioned above, the notification portion uses the display portion 52 to display a message prompting the user to mount the moisture-proof sheet 6 when the absorbent sheet type is selected from the input portion 51 and the electrode pair 7 detects the absence of the moisture-proof sheet 6 at the covering position. On the other hand, the process terminates when the presence of the moisture-proof sheet 6 is detected at step S5.

The above-mentioned process is performed when the user opens and closes the sheet cassette 101. This can prevent the user from forgetting to mount the moisture-proof sheet 6 when the absorbent sheet type is selected. In other words, the display portion 52 of the notification portion can notify the absence of the moisture-proof sheet 6 at the covering position. This can prevent a problem of leaving the moisture-proof sheet 6 unmounted when the user selects absorbent sheets such as art paper or coated paper for image formation. When the moisture-proof sheet 6 is unmounted, sheets are not separated sufficiently. As a result, two or more sheets may be fed together. A sheet may be jammed at a separating portion. The embodiment can solve these problems.

The embodiment displays the predetermined messages on the display portion 52 as the notification portion for the user. In addition, the notification portion may light an illuminator, generate an alarm sound, or appropriately combine related techniques.

Second Embodiment

Figure 6:
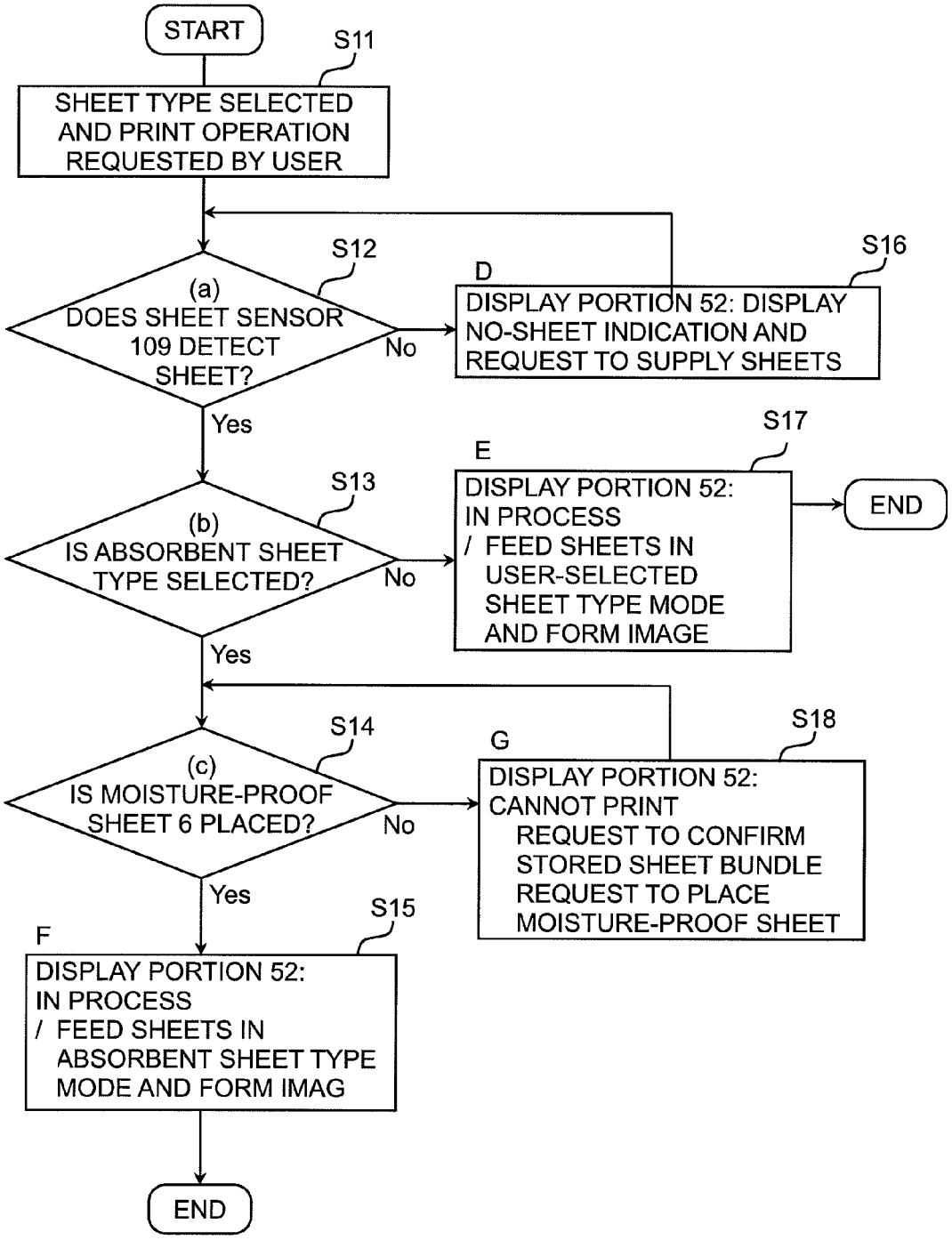
FIG. 6 is a flowchart concerning a moisture-proof sheet according to a second embodiment of the present invention.

A second embodiment of the present invention will be described with reference to FIG. 6. FIG. 6 is a flowchart illustrating a process concerning the moisture-proof sheet 6 when a print request is supplied to the image forming apparatus 10 according to the second embodiment. The second embodiment differs from the first embodiment only in the process. The second embodiment uses almost the same components as those illustrated in FIGS. 1 to 4 and will be described with reference to these drawings. The description of the same processes and configurations as the first embodiment will not be described for simplicity.

At step S11, the user selects a sheet type and issues a print request from the input portion 51. At step S12, the controlling portion 9 determines whether the sheet sensor 109 detects a sheet (a). When determining at step S12 that no sheet is detected (No), the controlling portion 9 proceeds to step S16 and allows the display portion 52 to display a message prompting the user to supply a sheet (D). When determining at step S12 that a sheet is detected (Yes), the controlling portion 9 proceeds to step S13 and determines whether the user selected the absorbent sheet type (b).

When determining at step S13 that the absorbent sheet type is not selected, the controlling portion 9 proceeds to step S17, starts feeding a sheet and forming an image (E) in the user-selected sheet type mode, and then terminates the process.

When determining at step S13 that the absorbent sheet type is not selected from the input portion 51, the controlling portion 9 can further determine whether the electrode pair 7 detects the moisture-proof sheet 6 at the covering position. In this case, the notification portion allows the display portion 52 to display a message prompting the user to confirm the correct sheet type is entered from the input portion 51. This can call the user's attention to inadvertent selection of a sheet type other than the absorbent sheet type.

When determining at step S13 that the absorbent sheet type is selected (Yes), the controlling portion 9 proceeds to step S14 and determines whether the moisture-proof sheet 6 is mounted at the covering position (c). When determining that the moisture-proof sheet 6 is mounted at the covering position (Yes), the controlling portion 9 proceeds to step S15 and starts feeding a sheet and forming an image in the absorbent sheet type mode (F).

There are two possibilities when the controlling portion 9 determines the absence of the moisture-proof sheet 6. One is that the moisture-proof sheet 6 remains unmounted on the absorbent sheet type. The other is that the stored sheet bundle S1 differs from the absorbent sheet type. The first case is highly likely to cause a feeding failure if sheets of absorbent type are stored in the sheet cassette 101 and then a print request is issued after a lapse of time long enough for the sheets to absorb moisture. Also in the second case, the stored sheet bundle S1 must be replaced.

When determining the absence of the moisture-proof sheet at step S14, the controlling portion 9 proceeds to step S18 as a process G and allows the display portion 52 to display inability of printing. The display portion 52 displays a message notifying that the sheets cannot be fed due to moisture absorption or an incorrect sheet type is selected for the stored sheet bundle S1. The message may request the user to confirm the state of the stored sheet bundle S1 and, if the sheets absorb moisture, replace the stored sheet bundle S1 with a new one or manually separate the sheets from each other so as to be free from the absorption. When a new sheet bundle is mounted, the display portion 52 displays a message alerting the user to mount the moisture-proof sheet 6.

According to the embodiment, the notification portion may notify the absorbent sheet type selected from the input portion 51. In addition, the electrode pair 7 may detect the absence of the moisture-proof sheet 6 at the covering position. In such a case, the display portion 52 displays the information for preventing the sheet feed operation. When a print request is issued, these processes can alert the user to a careless mistake even though an operator may forget to mount the moisture-proof sheet 6 on a sheet of the absorbent type or mount such sheet itself. In this manner, the second embodiment can provide the same effect as the first embodiment.

The second embodiment configures the notification portion using the input portion 51 and the display portion 52 of the user communication portion 5 of the image forming apparatus 10. In addition, the notification portion can be configured using an input portion and a display portion of information equipment such as a personal computer (PC) connected to the image forming apparatus 10. As a common case, different persons may supply sheets and issue a print request in an environment where multiple users issue a print request to one image forming apparatus through a network. The above-mentioned failure is highly likely to occur. The second embodiment is effective for this problem.

Third Embodiment

Figure 7:
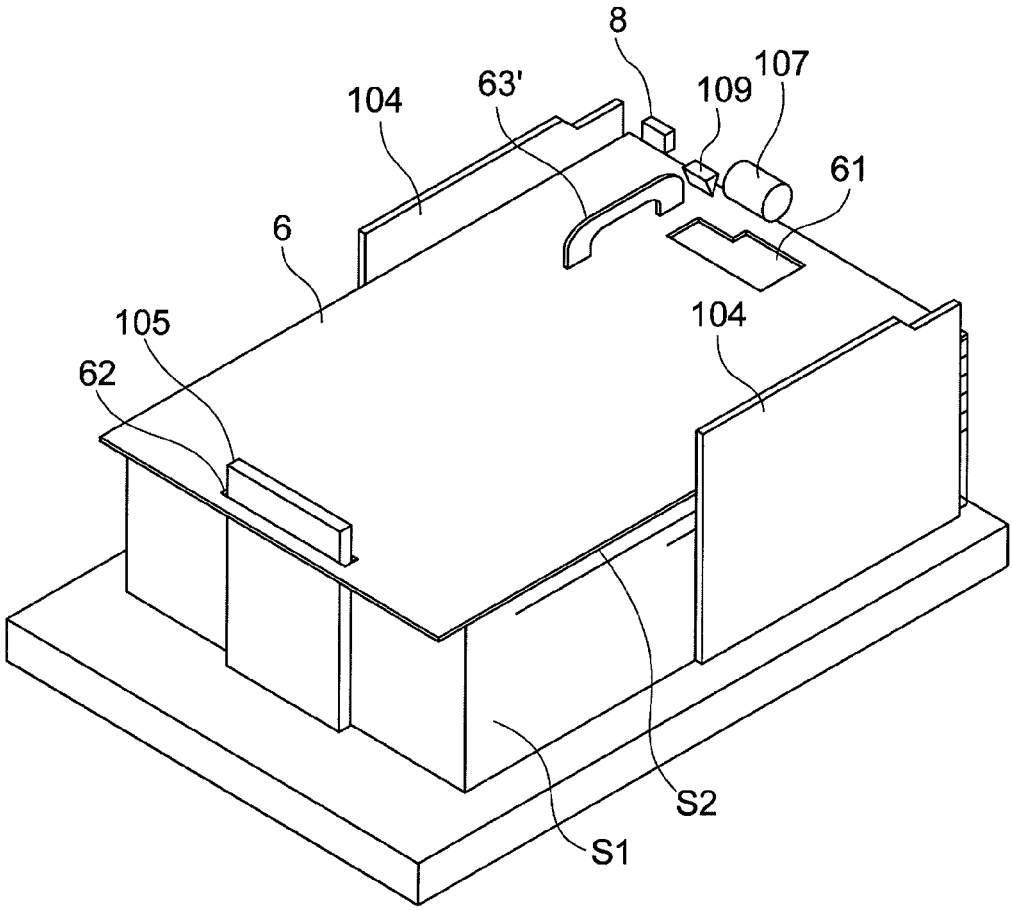
FIG. 7 is a schematic perspective view illustrating the inside of a sheet cassette according to a third embodiment of the present invention.
Figure 8:
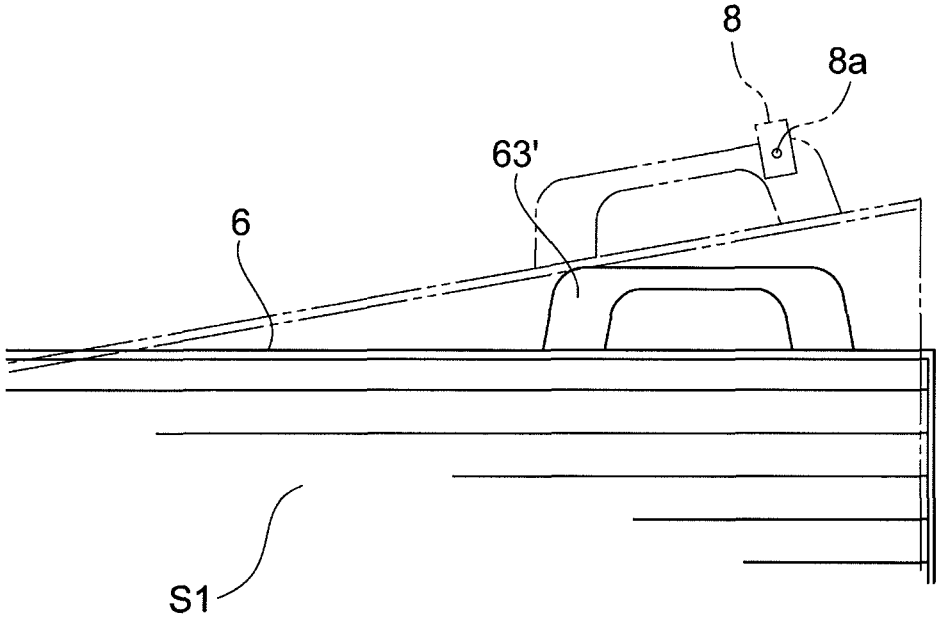
FIG. 8 is a schematic diagram illustrating moisture-proof sheet detection inside the sheet cassette according to the third embodiment.

A third embodiment of the present invention will be described with reference to FIGS. 7 and 8. FIG. 7 is a schematic perspective view illustrating the inside of the sheet cassette 101 according to the third embodiment. FIG. 8 is a schematic diagram illustrating detection of the moisture-proof sheet 6 inside the sheet cassette 101 according to the third embodiment. The same components as the first and second embodiments are depicted by the same reference numerals and a detailed description will not be described for simplicity.

The third embodiment replaces the electrode pair 7 of the first embodiment with a protrusion detection sensor 8 that is provided at a position near the electrode pair 7. The protrusion detection sensor (moisture-proof member detection portion) 8 detects whether a protruding portion 63' intercepts infrared light between a light emitting element for irradiating the infrared light and a light sensitive element for receiving the light. The protruding portion 63' is shaped into a flat plate and is attached near the aperture 61. The protrusion detection sensor 8 electrically turns on or off according to movement of the plate-shaped protruding portion 63'. In other words, the protrusion detection sensor 8 detects an electric change to detect the presence or absence of the moisture-proof sheet 6.

The protruding portion 63' is shaped into a handle for the moisture-proof sheet 6 for easy manual handling.

As illustrated by broken lines in FIG. 8, the moisture-proof sheet 6 lifts to a predetermined position as the support plate 103 lifts. The protruding portion 63' reaches an infrared light point 8*a* of the protrusion detection sensor 8 and intercepts the light. The controlling portion 9 receives a generated signal to determine that the moisture-proof sheet 6 is available. Similarly to the protruding portion 63 according to the first and second embodiments, the protruding portion 63' prevents a sheet from being placed flat on the moisture-proof sheet 6. In this manner, the protruding portion 63' prevents sheets to be stored in the sheet cassette 101 from being inadvertently placed on the moisture-proof sheet. The protrusion detection sensor 8 may be configured as a switch-type sensor that can be pressed by the protruding portion 63' to detect the moisture-proof sheet 6.

The third embodiment provides almost the same effect as the first and second embodiments. Since the mechanical sensor detects the protruding portion 63', the embodiment can also more accurately detect the presence or absence of the moisture-proof sheet 6 regardless of conductive performance of the moisture-proof sheet 6.

Fourth Embodiment

Figure 9:
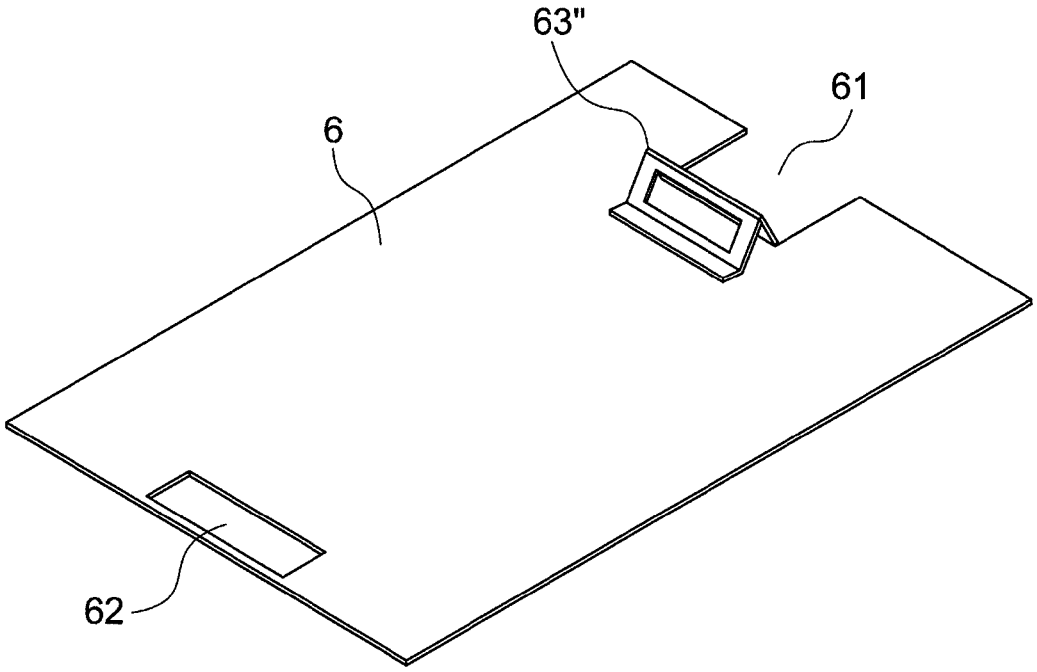
FIG. 9 is a schematic perspective view illustrating a moisture-proof sheet according to a fourth embodiment of the invention.
Figure 10:
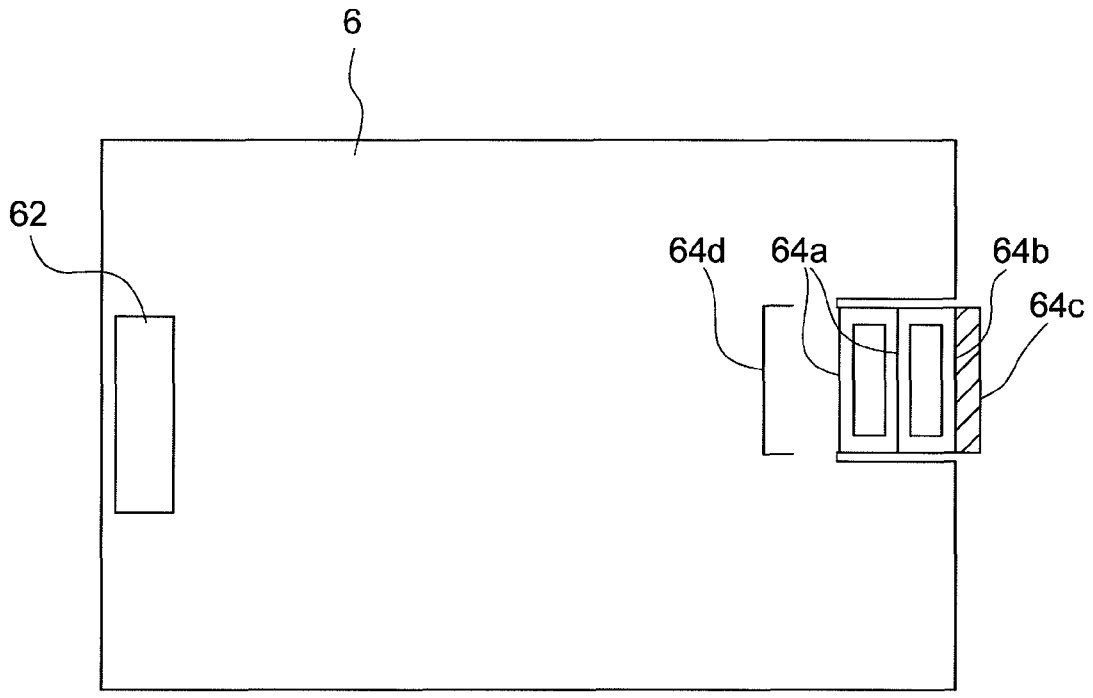
FIG. 10 is a developed plan view illustrating the moisture-proof sheet according to the fourth embodiment.

A fourth embodiment of the present invention will be described with reference to FIGS. 9 and 10. FIG. 9 is a schematic perspective view illustrating the moisture-proof sheet 6 according to the fourth embodiment. FIG. 10 is a developed plan view illustrating the moisture-proof sheet 6 according to the fourth embodiment. The same components as the above-mentioned embodiments are depicted by the same reference numerals and a detailed description will not be described for simplicity.

As illustrated in FIGS. 9 and 10, the moisture-proof sheet (moisture-proof member) 6 is shaped into a sheet. The protruding portion 63" according to the embodiment is formed by bending part of the flat-sheet like moisture-proof sheet 6. Specifically, the protruding portion 63" is formed as illustrated in FIG. 9 by bending along two valley fold lines 64*a* and one mountain fold line 64*b* and fastening an adhering face 64*c* using a double-sided adhesive tape in alignment with a line 64*d*. An aperture 61 is formed after the bending. The protruding portion 63" according to the embodiment is also shaped into a handle for the moisture-proof sheet 6.

Multiple moisture-proof sheets 6 can be stacked flat before the protruding portion 63" is formed according to the above-mentioned technique. The moisture-proof sheet 6 is very portable when it is supplied as after-sales service for the image forming apparatus 10. A technique similar to that described in the first to third embodiments can be used to detect the moisture-proof sheet 6 having the protruding portion 63" according to the fourth embodiment at the covering position.

While the present invention has been described with reference to exemplary embodiments, it is to be understood that the invention is not limited to the discussed exemplary embodiments. The scope of the following claims is to be accorded the broadest interpretation so as to encompass all modifications, equivalent structures and functions.

This application claims the benefit of Japanese Patent Application No. 2010-093920, filed Apr. 15, 2010, which is hereby incorporated by reference herein in its entirety.

What is claimed is:

1. An image forming apparatus having a sheet store portion which is detachably attached to an apparatus body, a sheet stacking portion which can be lifted up in the sheet store portion, a sheet feeding portion which feeds a topmost sheet of sheets stacked on the sheet stacking portion, and an image forming portion which forms an image on the sheet fed by the sheet feeding portion, the image forming apparatus further comprising:

a moisture-proof member which is made of a thin, flat material impervious to moisture and is set to a contacting position so as to be substantially in contact with an entire surface of the topmost sheet of sheets stacked on the sheet stacking portion;

a regulating portion which regulates a movement of the moisture-proof member while the topmost sheet is fed by the sheet feeding portion;

a moisture-proof member detection portion which detects a presence and absence of the moisture-proof member at the contacting position when the sheet stacking portion is lifted up;

an input portion used to input a sheet type for the topmost sheet;

a display portion which displays a request for a predetermined operation; and a controlling portion which determines whether or not the sheet type input from the input portion is an absorbent sheet type, wherein in response to a determination by the controlling portion that the sheet type input from the input portion is an absorbent sheet type and that the moisture-proof member is absent at the contacting position based on a detection result from the moisture-proof member detection portion, the controlling portion controls the display portion to display a prompt to mount the moisture-proof member.

2. The image forming apparatus according to claim 1, wherein the moisture-proof member, while set to the contacting position, has a protruding portion which protrudes upward, and the protruding portion is configured to call attention to a placement of a sheet on the moisture-proof member.

3. The image forming apparatus according to claim 1, wherein the moisture-proof member is made of a conductive member; and the moisture-proof member detection portion includes a pair of electrodes capable of being in contact with the moisture-proof member and detects the presence or absence of the moisture-proof member based on the presence or absence of conduction between the pair of electrodes.

4. The image forming apparatus according to claim 2, wherein the protruding portion is shaped into a flat plate, and the moisture-proof member detection portion detects an electric change due to movement of the protruding portion and detects the presence or absence of the moisture-proof member.

5. The image forming apparatus according to claim 2, wherein the moisture-proof member is shaped into a sheet, and the protruding portion is formed by bending moisture-proof member.

6. The image forming apparatus according to claim 2, wherein the protruding portion is configured to be used as a handle for the moisture-proof member.

7. An image forming apparatus having a sheet store portion which is detachably attached to an apparatus body, a sheet stacking portion which can be lifted up in the sheet store portion, a sheet feeding portion which feeds a topmost sheet of sheets stacked on the sheet stacking portion, and an image forming portion which forms an image on the sheet fed by the sheet feeding portion, the image forming apparatus further comprising:

a moisture-proof member which is made of a thin, flat material impervious to moisture and is set to a contacting position so as to be substantially in contact with an entire surface of the topmost sheet of sheets stacked on the sheet stacking portion;

a regulating portion which regulates a movement of the moisture-proof member while the topmost sheet is fed by the sheet feeding portion;

a moisture-proof member detection portion which detects a presence and absence of the moisture-proof member at the contacting position when the sheet stacking portion is lifted up;

an input portion used to input a sheet type for the topmost sheet;

a display portion which displays a request for a predetermined operation; and a controlling portion which determines whether or not the sheet type input from the input portion is an absorbent sheet type, wherein in response to a determination by the controlling portion because the controlling portion determines that the sheet type input from the input portion is an absorbent sheet type and that the moisture-proof member is absent at the contacting position based on a detection result from the moisture-proof member detection portion, the controlling portion controls the display portion to display a prompt to inhibit a sheet feeding operation.

8. The image forming apparatus according to claim 7, wherein when the controlling portion determines that the sheet type input from the input portion is not an absorbent sheet type and that the moisture-proof member is present at the contacting position based on a detection result from the moisture-proof member detection portion, the controlling portion controls the display portion to display a prompt to confirm correctness of a sheet type input from the input portion.

* * * * *